US009683580B2

(12) United States Patent
Tyler et al.

(10) Patent No.: US 9,683,580 B2
(45) Date of Patent: Jun. 20, 2017

(54) HINGE INTERFACE FOR TWO-PIECE FAN SHROUD

(71) Applicant: FORD GLOBAL TECHNOLOGIES, LLC, Dearborn, MI (US)

(72) Inventors: James S. Tyler, Livonia, MI (US); Saulo Da Cortes Cervantes, Tlalnepantla de Baz (MX)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 290 days.

(21) Appl. No.: 14/704,189

(22) Filed: May 5, 2015

(65) Prior Publication Data

US 2016/0327058 A1 Nov. 10, 2016

(51) Int. Cl.

| | |
|---|---|
| ***F04D 29/52*** | (2006.01) |
| ***F04D 29/64*** | (2006.01) |
| ***F04D 29/60*** | (2006.01) |
| ***F04D 29/66*** | (2006.01) |
| ***F04D 19/00*** | (2006.01) |
| ***F01P 1/06*** | (2006.01) |
| ***F01P 5/06*** | (2006.01) |

(52) U.S. Cl.

CPC ..... *F04D 29/526* (2013.01); *F01P 1/06* (2013.01); *F01P 5/06* (2013.01); *F04D 19/002* (2013.01); *F04D 29/601* (2013.01); *F04D 29/646* (2013.01); *F04D 29/668* (2013.01); *Y10T 16/54* (2015.01)

(58) Field of Classification Search

CPC ..... F04D 29/526; F04D 29/4226; F04D 29/4253; F04D 29/646; F04D 29/545; F04D 29/601; E05C 17/38; Y10T 16/540257; Y10T 16/540256; Y10T 16/54028; Y10T 16/54026; A42B 3/221; F16B 21/02

USPC ..... 24/544, 581.12; 415/214.1, 126

See application file for complete search history.

(56) References Cited

U.S. PATENT DOCUMENTS

| | | | | |
|---|---|---|---|---|
| 4,353,680 | A | 10/1982 | Hiraoka et al. | |
| 4,522,160 | A | 6/1985 | Speers et al. | |
| 4,741,669 | A | 5/1988 | Shimokawabe | |
| 5,410,992 | A | 5/1995 | Hunt et al. | |
| 7,077,624 | B2 | 7/2006 | Brown | |
| 7,137,772 | B2 * | 11/2006 | Blateri | F04D 29/646 415/1 |
| 7,585,149 | B2 | 9/2009 | Skotrikov et al. | |

(Continued)

*Primary Examiner* — Dwayne J White
*Assistant Examiner* — Topaz L Elliott
(74) *Attorney, Agent, or Firm* — Gregory P. Brown; MacMillan, Sobanski & Todd, LLC

(57) ABSTRACT

A cooling fan shroud for an internal combustion engine has a fan port including a fixed cylindrical segment and a movable cylindrical segment mounted by a hinge. A pivot plate on the movable cylindrical segment is compressed with a base plate on a shroud main body so that a loading rib on one plate provides a frictional resistance. A dual-position locking mechanism retains the movable cylindrical segment in an extended position or a retracted position. The mechanism is comprised of a tab extending from the movable cylindrical segment and a ratchet pocket in the main body receiving the tab, wherein the ratchet pocket has a pair of stop notches separated by a deflector rib. The movable cylindrical segment is bendable to allow the tab to ride over the deflector rib in response to a predetermined pivot force applied to the movable cylindrical segment.

4 Claims, 8 Drawing Sheets

(56) References Cited

U.S. PATENT DOCUMENTS

| | | | | |
|---|---|---|---|---|
| 7,841,026 | B2 * | 11/2010 | Makris | A42B 3/0433 2/410 |
| 8,133,006 | B2 * | 3/2012 | Yoshida | F04D 19/007 415/68 |
| 8,182,217 | B2 | 5/2012 | Schaffer et al. | |
| 2006/0081353 | A1 | 4/2006 | Inniger et al. | |
| 2009/0111372 | A1 * | 4/2009 | Hsu | F04D 19/007 454/190 |
| 2013/0118311 | A1 * | 5/2013 | Bender | A61B 17/3201 76/104.1 |

* cited by examiner

HINGE INTERFACE FOR TWO-PIECE FAN SHROUD

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to a shroud for surrounding a cooling fan of an internal combustion engine, and, more specifically, to a shroud with a hinged portion for facilitating assembly onto an engine in an engine compartment of a vehicle.

In one common assembly process for automotive vehicles, an internal combustion engine is mounted onto the vehicle frame and then a vehicle body is lowered onto the frame/engine assembly. Typically, the body carries a cooling module (e.g., a radiator, condenser, and fan shroud). When an engine-driven fan is used, the fan is already installed on the engine at the time when the body/cooling module is added to the frame. In order to avoid interference between the shroud and fan during placement of the cooling module, the barrel portion of the shroud has been provided with an articulating or removable segment that can be moved into the proper position after placement of the cooling module.

For ease of assembly, a movable barrel segment is preferably pre-installed on the shroud which can be pulled into position after installation of the cooling module over the engine. This pivotable segment is mounted by a hinge in order to swivel between i) a shipping position with the segment retracted within the shroud main body, and ii) a locked position which encloses the fan. To prevent damage to the shroud components during shipping and handling of the shroud, it is desirable to secure the movable segment at the retracted position prior to vehicle installation when it is moved to the extended position around the fan. It is also desirable that the movement from the retracted position to the extended position can be achieved easily and robustly, simultaneously ensuring strong retention at the extended position without demanding any difficult assembly operations. In one conventional design, a molded pin or clip has been used as a hinge. Spring arms on the clip would compress in order to install the clip through pivot holes on the two shroud pieces and then would create enough friction within the hinge to prevent the movable segment from pivoting freely. The clips, however, are subject to breakage at an unacceptably high rate, and performance is less than optimal because the relatively high amount of friction used for keeping the movable section in place during shipping and handling is also present during the entire swiveling movement to enclose the fan, which increases the assembly efforts.

SUMMARY OF THE INVENTION

In one aspect of the invention, a cooling fan shroud has a main body with a radiator port and a fan port. The fan port has a fixed cylindrical segment defining a partial cylinder at a top side of the fan port and a lower rim along a bottom side of the fan port that is stepped down from an edge of the fixed cylindrical segment. A movable cylindrical segment is mounted to the main body by a hinge comprised of a pivot plate on the movable cylindrical segment compressed with a base plate on the main body. One of the plates includes a loading rib to provide a predetermined frictional resistance. The movable cylindrical segment is configured to extend above the lower rim in an extended position to form a complete cylindrical ring with the fixed cylindrical segment and to pivot behind the lower rim to a retracted position. A dual-position locking mechanism retains the movable cylindrical segment in the extended position or the retracted position. The mechanism is comprised of a tab extending from the movable cylindrical segment and a ratchet pocket in the main body receiving the tab, wherein the ratchet pocket has a pair of stop notches separated by a deflector rib. The movable cylindrical segment is bendable to allow the tab to ride over the deflector rib in response to a predetermined pivot force applied to the movable cylindrical segment.

DETAILED DESCRIPTION OF PREFERRED EMBODIMENTS

Figure 1:
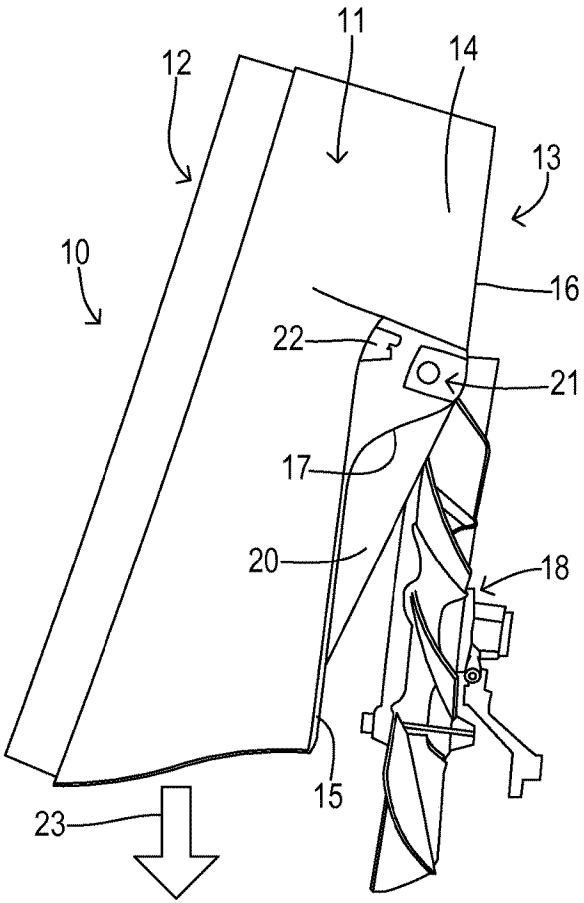
FIG. 1 is a side view of a fan shroud of the present invention in a retracted, shipping position during placement over an engine cooling fan.

Referring to FIG. 1, a fan shroud assembly 10 includes a main body 11 and a movable cylindrical segment 20. Main body 11 has a radiator port 12 and a fan port 13. Fan port 13 has a fixed cylindrical segment 14 defining a partial cylinder at a top side of fan port 13 and has a lower rim 15 along a bottom side of fan port 13. A step 17 transitions from an outer edge 16 of fixed cylindrical segment 14 down to lower rim 15. FIG. 1 shows movable cylindrical segment 20 in its retracted position wherein segment 20 is pivoted behind lower rim 15 in order to allow shroud 10 to be lowered over a fan 18 in the direction of an arrow 23.

Figure 2:
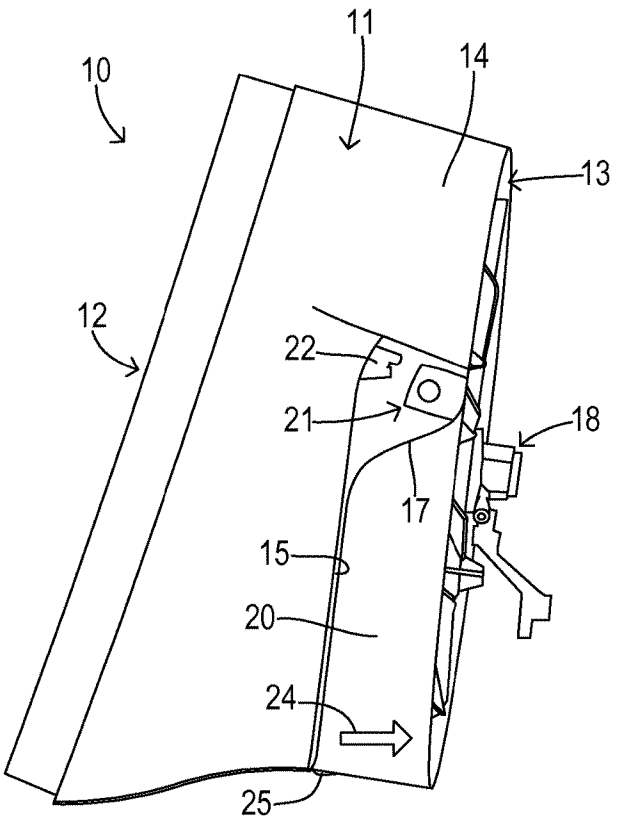
FIG. 2 is a side view of the fan shroud of FIG. 1 after extending into a locked position over the cooling fan.

Movable cylindrical segment 20 is attached to fixed cylindrical segment 14 at a hinge 21. A dual-position locking mechanism 22 locks movable cylindrical segment 20 in the retracted position shown in FIG. 1 as will be described in greater detail below. FIG. 2 shows shroud 10 after it has been fully lowered onto fan 18 and after movable cylindrical segment 20 has been moved into its extended position along an arrow 24. Dual-position locking mechanism 22 likewise locks segment 20 in the extended position. In addition, one or more peripheral clips 25 may be provided on cylindrical segment 20 to grasp lower rim 15 for additional retention in the extended position. When movable cylindrical segment 20 is in the extended position, it cooperatively forms a complete cylindrical ring around fan 18 with fixed cylindrical segment 14. The cylindrical ring or barrel provides a constrained air flow path between a radiator and an internal combustion engine (not shown) via fan 18.

Figure 3:
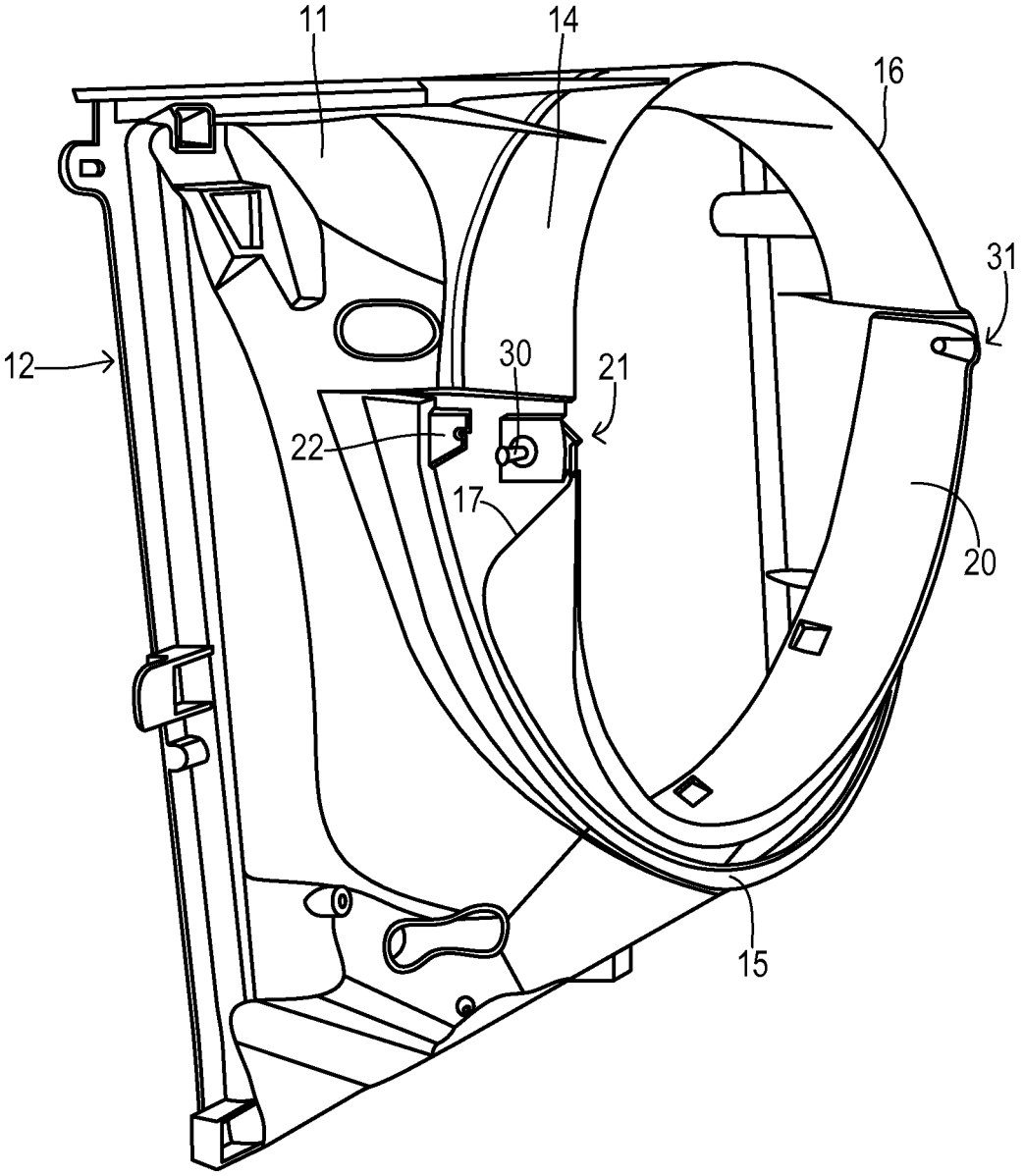
FIG. 3 is a rear, perspective view of the fan shroud in the retracted position.
Figure 4:
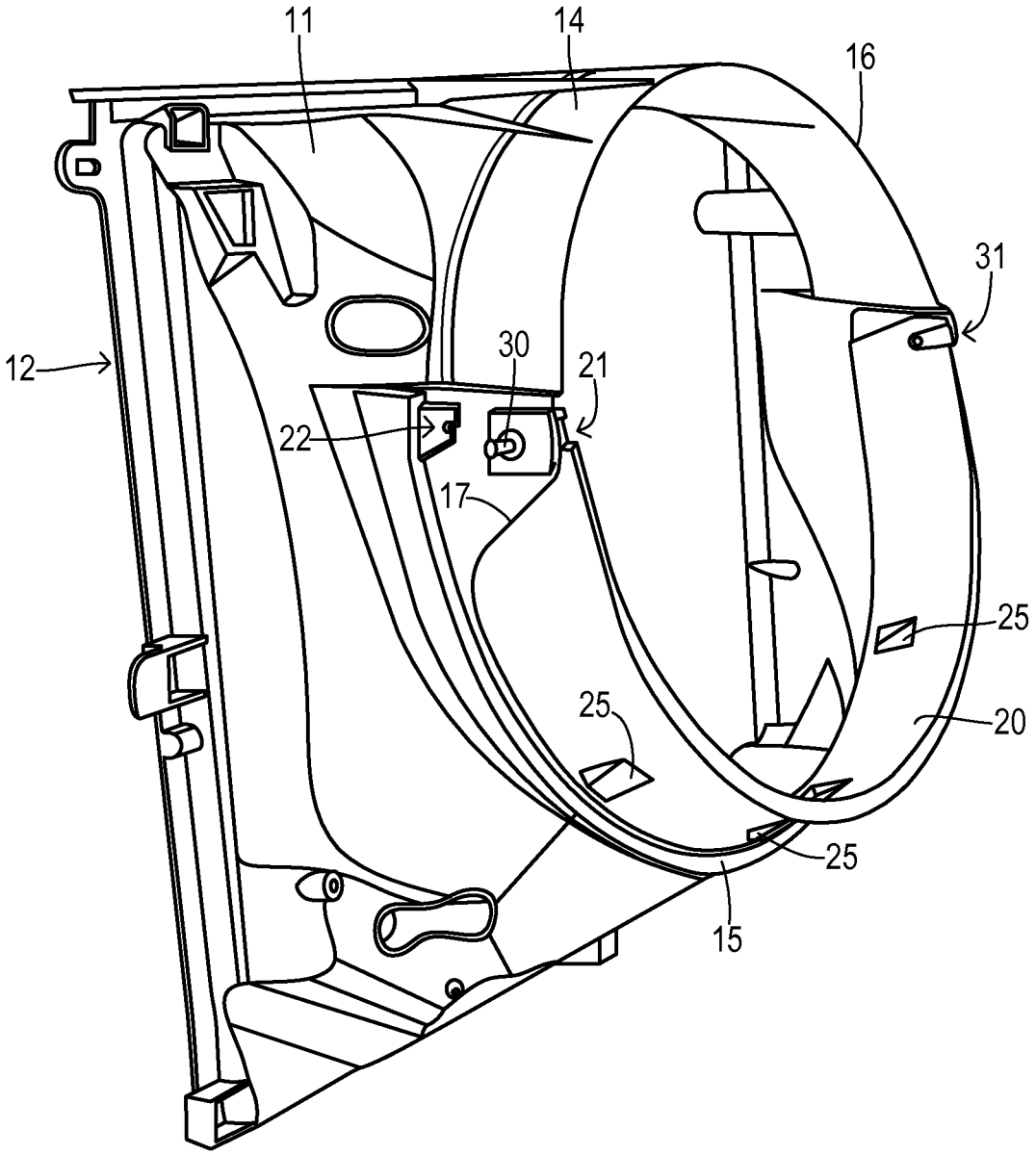
FIG. 4 is a rear, perspective view of the fan shroud in the extended position.

FIG. 3 is a perspective view showing movable cylindrical segment 20 in its retracted position pivoted behind lower rim 15. Dual-position locking mechanism 22 assumes a first locked configuration to hold movable segment 20 in the retracted position. Hinge 21 includes a fastening pin 30 passing through respective pivot holes in the cylindrical segments. A hinge 31 located at the opposite side of movable segment 20 has a similar construction to hinge 21. Fastening pin 30 is shown as a push pin or screw activated plastic rivet (also known as a scrivet). The scrivet is shown with a central body in an initial (unactivated) position to facilitate insertion into pivot holes in the cylindrical segments (i.e., prior to longitudinal insertion of the central body fully into the scrivet to fasten the hinge). In FIG. 4, movable segment 20 is in its extended position wherein dual-position locking mechanism 22 assumes a second locked configuration.

Figure 5:
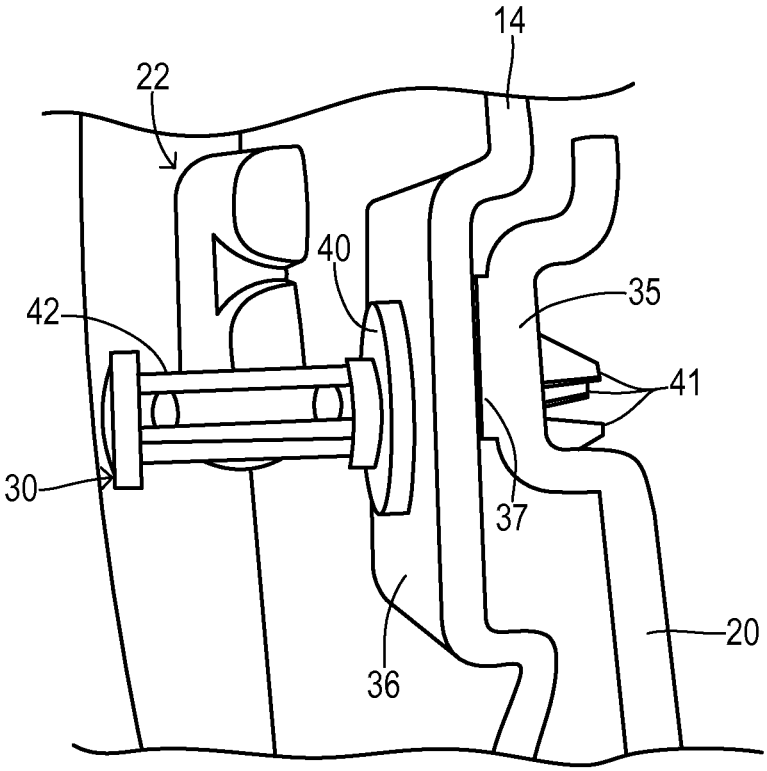
FIG. 5 is a top view of the hinge with a fastening pin partially installed.
Figure 6:
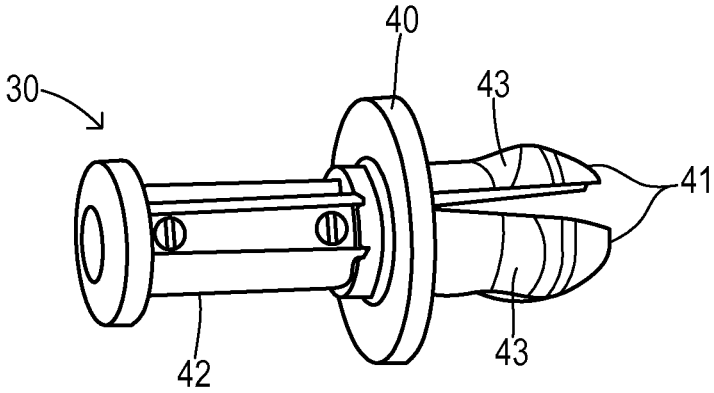
FIG. 6 is a side, perspective view of the fastening pin in the form of a scrivet.

The hinge for producing the swiveling motion of cylindrical segment 20 is shown in greater detail in FIG. 5. Movable segment 20 includes a pivot plate 35 juxtaposed with a base plate 36 on fixed cylindrical segment 14. To ensure smooth movement with a predetermined frictional resistance, plates 35 and 36 are compressed together by a fastening pin 30, and the contacting surfaces include a loading rib 37 which extends from pivot plate 35. In order to compress the plates, fastening pin 30 includes a first scrivet component comprised of a flange 40 with integral legs 41, wherein flange 40 rests upon an outer surface of base plate 36 and legs 41 extend through pivot holes in plates 35 and 36. Legs 41 are expandable and have bearing surfaces 43 which receive an outer surface of pivot plate 35 after legs 41. The hinge joint is locked together by expanding legs 41 as a result of inserting a scrivet pin 42 fully through flange 40 and the pivot holes. This spreads legs 41 apart and retains plates 35 and 36 together between flange 40 and bearing surfaces 43. The dimensions of loading rib 37 are chosen to provide sufficient tension to keep the swivel joint tight when in the locking position and to adjust the ergonomic effort associated with moving segment 20 between positions (in conjunction with the action of locking mechanism 22 described below).

Figure 7:
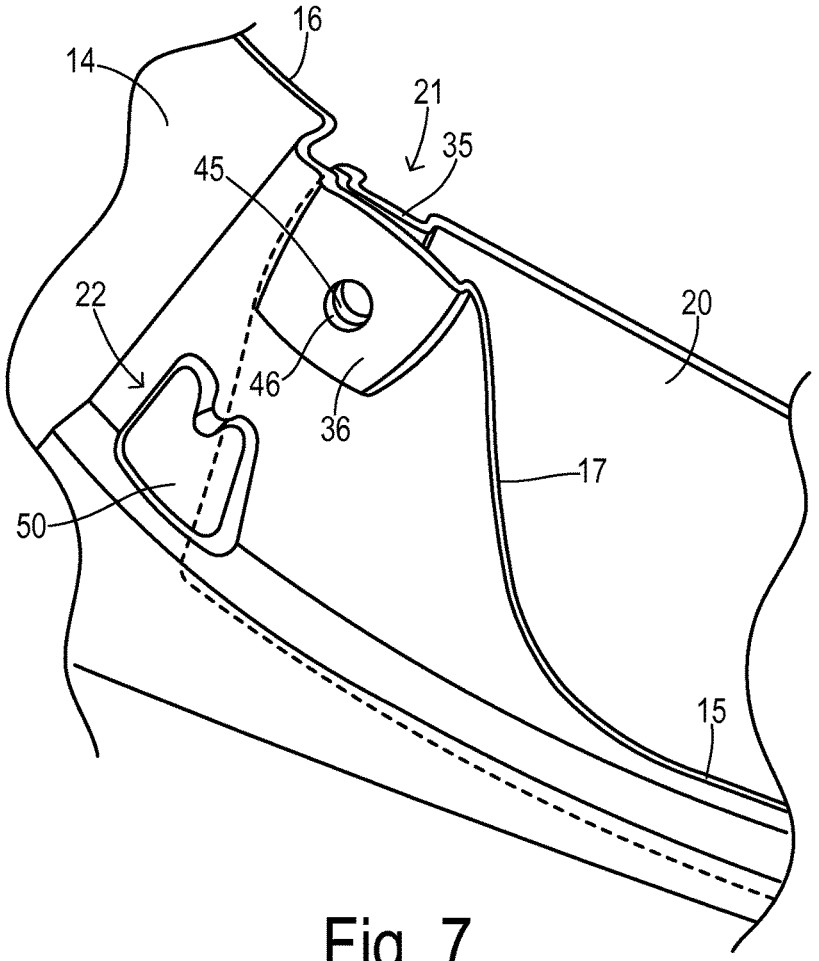
FIG. 7 is a close-up of hinge and locking features of fixed and movable shroud segments.
Figure 8:
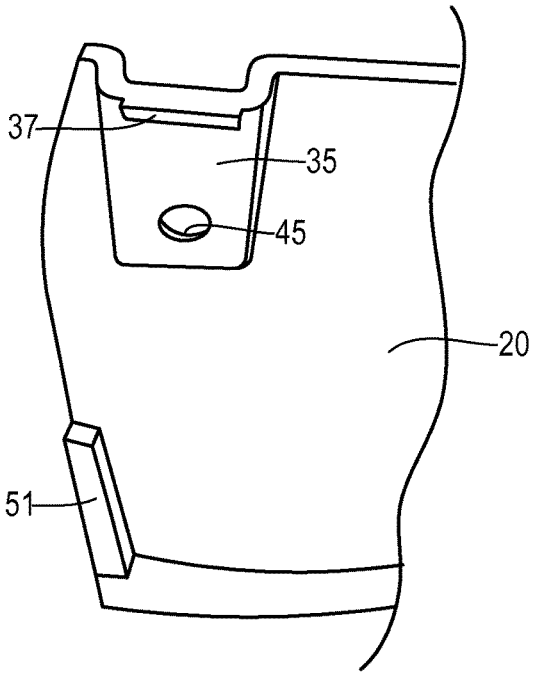
FIG. 8 shows hinge and locking features on the movable shroud segment in greater detail.

FIG. 7 shows the interface between fixed segment 14 and movable segment 20 in greater detail with the scrivet removed to show pivot holes 45 and 46 in plates 35 and 36, respectively. In addition to the pushpin scrivet illustrated herein, other fastening pins such as a screw activated scrivet or other resilient or molded clips can be employed. FIG. 7 shows the orientation of movable cylindrical segment 20 in its extended position wherein a complete cylindrical ring is formed by segments 14 and 20. Dual-position locking mechanism 22 includes a ratchet pocket 50 formed on main shroud body 11 (e.g., located on fixed cylindrical segment 14) which receives a tab 51 which extends from a side of movable cylindrical segment 20 as shown in FIG. 8. The two locked configurations of latching mechanism 22 are shown in FIGS. 9-12.

Figure 9:
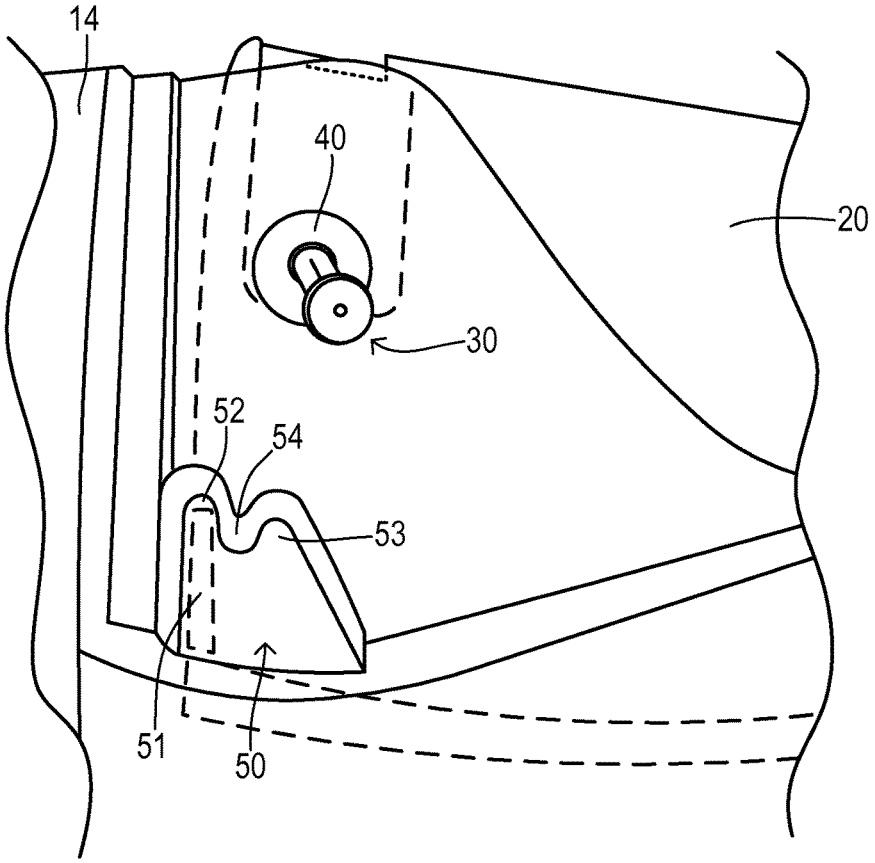
FIG. 9 is an outside view of the shroud assembly hinge and locking features with the movable segment in the retracted position.
Figure 10:
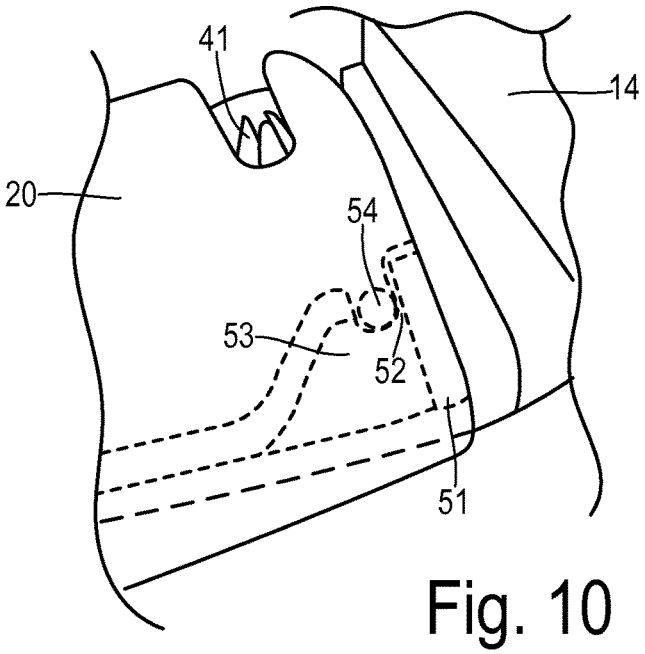
FIG. 10 is an inside view of the shroud assembly hinge and locking features with the movable segment in the retracted position.
Figure 11:
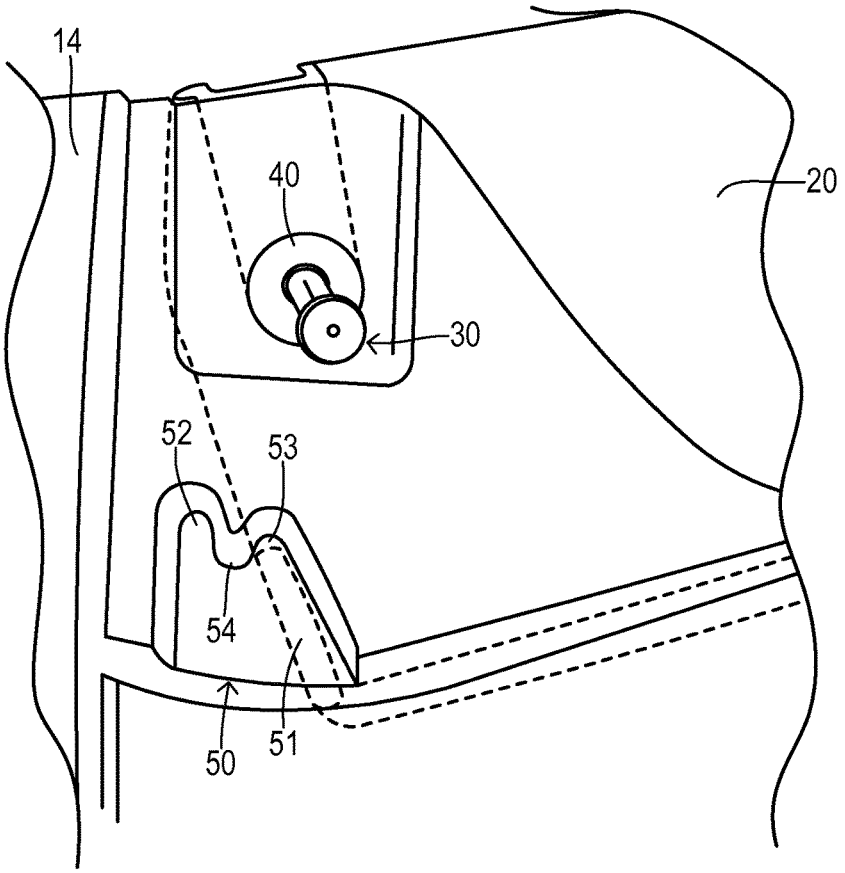
FIG. 11 is an outside view of the shroud assembly hinge and locking features with the movable segment in the extended position.
Figure 12:
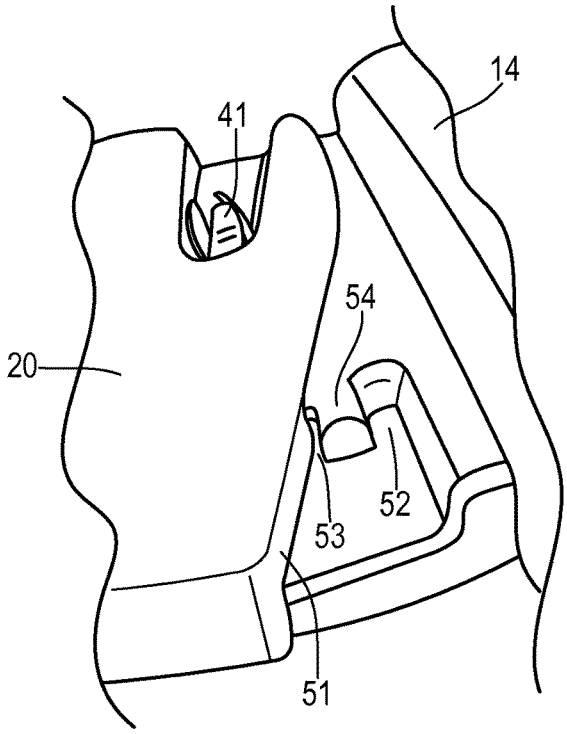
FIG. 12 is an inside view of the shroud assembly hinge and locking features with the movable segment in the extended position.

FIGS. 9 and 10 show cylindrical segment 20 in its retracted position wherein tab 51 is captured in a stop notch 52 of ratchet pocket 50. Stop notch 52 is separated from another stop notch 53 by a deflector rib 54. Tab 51 acts as a detent in a ratchet mechanism to lock segment 20 in the two positions corresponding to notches 52 and 53. The capturing of tab 51 in stop notch 52 together with the frictional resistance provided by the hinge ensures that movable segment 20 remains in the retracted position during shipment and during initial installation of a corresponding cooling module over the cooling fan and into the vehicle engine compartment. Figures 11 and 12 show the state of tab 51 in ratchet pocket 50 after movable cylindrical segment 20 is moved to the extended position. Thus, tab 51 is captured in second stop notch 53 after segment 20 is pivoted around fastening pin 30. By comparing the position of tab 51 in FIGS. 9 and 10 with the position of tab 51 in FIGS. 11 and 12, it can be seen that mating edges of deflector rib 54 and tab 51 are generally parallel in the retracted position, whereas the mating edges of tab 51 and deflector rib 54 in the extended position are disposed at an acute angle. The acute angle results from the rotation of tab 51 and from the fact that the two sides of rib 54 are parallel with each other. In the parallel edge arrangement of the retracted position, less force is required to move tab 51 over deflector rib 54 than in the extended position because of increased surface contact and better leverage. Movement from the extended position to the retracted position requires tab 51 to move over deflector rib 54 starting at an acute angle with less contact and less leverage.

Figure 13:
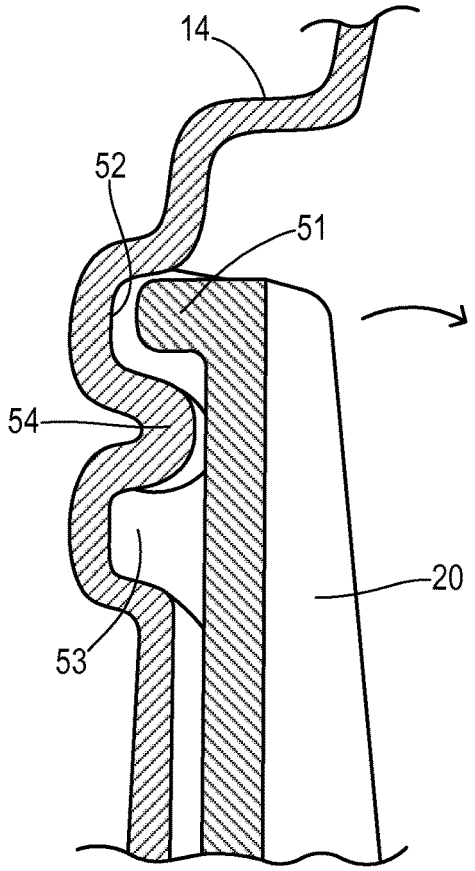
FIG. 13 is a cross-sectional view of the dual-position locking mechanism.

As shown in FIG. 13, movable segment 20 is bendable (e.g., as a result of being made of molded plastic) in order to allow tab 51 to ride over deflector rib 54 whenever a predetermined pivot force is applied to movable segment 20. The resulting acute angle between tab 51 and deflector rib 54 when attempting to move from the extended position to the retracted position ensures that the required force is increased to a level that ensures reliable retention of movable segment 20 in the extended position over many years of vehicle service.

Figure 14:
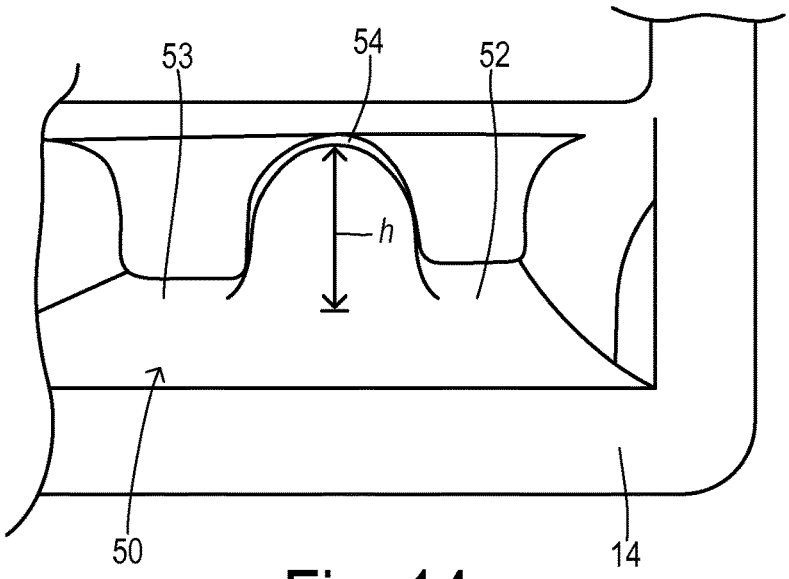
FIG. 14 is an end view of the ratchet pocket formed in the main body of the shroud.

FIG. 14 is an end view within ratchet pocket 50 wherein deflector rib 54 has a height h. By changing height h and the slope of the sides of deflector rib 54, the force needed to move from the retracted position to the extended position or from the extended position to the retracted position can be specified as needed for various vehicle applications.

The foregoing invention provides a swivel interface and locking mechanism that is easy to service (e.g., a scrivet can be easily snapped in and out for replacement of a movable segment). The interface is tighter and more robust than prior hinge mechanisms which achieves reduced vibrations. The loading rib and deflector rib structures can be easily tailored for different vehicle designs in order to provide desired ergonomic performance without introducing complicated molding features.

What is claimed is:

1. A cooling fan shroud comprising:

a main body having a radiator port and a fan port, wherein the fan port has a fixed cylindrical segment defining a partial cylinder at a top side of the fan port and has a lower rim along a bottom side of the fan port that is stepped down from an edge of the fixed cylindrical segment; and a movable cylindrical segment mounted to the main body by a hinge comprised of a pivot plate on the movable cylindrical segment compressed with a base plate on the main body, wherein one of the plates includes a loading rib to provide a predetermined frictional resistance, wherein the movable cylindrical segment is configured to extend above the lower rim in an extended position to form a complete cylindrical ring with the fixed cylindrical segment, and wherein the movable cylindrical segment is configured to pivot behind the lower rim to a retracted position;

wherein a dual-position locking mechanism retains the movable cylindrical segment in the extended position or the retracted position, wherein the mechanism is comprised of a tab extending from the movable cylindrical segment and a ratchet pocket in the main body receiving the tab, wherein the ratchet pocket has a pair of stop notches separated by a deflector rib, and wherein the movable cylindrical segment is bendable to allow the tab to ride over the deflector rib in response to a predetermined pivot force applied to the movable cylindrical segment.

2. The shroud of claim 1 wherein the tab and the deflector rib are generally parallel in the retracted position, and wherein the tab and the deflector rib are disposed at an acute angle in the extended position, so that less force is required to move from the retracted position to the extended position than from the extended position to the retracted position.

3. The shroud of claim 1 further comprising:

a fastening pin passing through respective pivot holes in the base plate and the pivot plate.

4. The shroud of claim 3 wherein the fastening pin is comprised of a plastic scrivet.

* * * * *